US010143322B2

(12) United States Patent
Cheng et al.

(10) Patent No.: US 10,143,322 B2
(45) Date of Patent: Dec. 4, 2018

(54) UNIVERSAL TREE STAND SYSTEMS AND METHODS

(71) Applicant: POLYGROUP MACAU LIMITED (BVI), Road Town, Tortola (VG)

(72) Inventors: Elmer Chi Hang Cheng, Midlevel (HK); Victor Hugo Ocegueda Gallaga, Tijuana (MX); Yifeng Zhang, Xinxiang (CN)

(73) Assignee: Polygroup Macau Limited (BVI), Road Town (VG)

( * ) Notice: Subject to any disclaimer, the term of this patent is extended or adjusted under 35 U.S.C. 154(b) by 0 days.

(21) Appl. No.: 15/433,308

(22) Filed: Feb. 15, 2017

(65) Prior Publication Data

US 2017/0231412 A1 Aug. 17, 2017

Related U.S. Application Data

(60) Provisional application No. 62/295,726, filed on Feb. 16, 2016.

(51) Int. Cl.
*A47G 33/12* (2006.01)
*E04H 12/22* (2006.01)

(52) U.S. Cl.
CPC ..... *A47G 33/1206* (2013.01); *E04H 12/2238* (2013.01); *A47G 2033/1266* (2013.01)

(58) Field of Classification Search
CPC ..... A47G 33/1206; A47G 2033/1266; A47G 33/12
USPC ..... 248/158, 161, 404, 412, 157, 420, 248/229.13, 229.23, 231.51, 316.5, 523; 47/42, 40.5
See application file for complete search history.

(56) References Cited

U.S. PATENT DOCUMENTS 224,624 A * 2/1880 Albrecht ..... A47G 33/12 248/524
1,497,683 A * 6/1924 Hall ..... A47G 33/1206 248/526
1,598,016 A * 8/1926 Runser ..... A47G 33/12 248/524
4,119,290 A * 10/1978 Gies ..... A47G 33/12 248/523
4,261,138 A * 4/1981 St. George Syms .. A47G 33/12 248/523
D330,346 S * 10/1992 Bryand ..... D11/130.1
5,517,878 A * 5/1996 Klein ..... B62K 21/16 403/371
5,893,547 A * 4/1999 Cohen, Jr. ..... F16M 11/08 248/521
5,938,168 A * 8/1999 Adams ..... A47G 33/12 248/523
6,983,921 B1 * 1/2006 Rahmer ..... A47G 33/1226 248/523
9,677,749 B2 * 6/2017 Chen ..... A47G 33/06
(Continued)

*Primary Examiner* — Muhammad Ijaz
(74) *Attorney, Agent, or Firm* — Troutman Sanders LLP; Ryan A. Schneider; Christopher C. Close, Jr.

(57) ABSTRACT

The disclosed technology includes a universal tree stand for supporting trees with tree trunks of various sizes. The universal tree stand may include a clamping element to flexibly receive and secure tree trunks of different sizes. The universal tree stand may further include a fastening element that can tighten the grip of the clamping element around the tree trunk.

7 Claims, 5 Drawing Sheets

(56) References Cited

U.S. PATENT DOCUMENTS

| | | | | |
|---|---|---|---|---|
| 2004/0026594 | A1* | 2/2004 | Lee | A47G 33/12<br>248/523 |
| 2006/0083009 | A1* | 4/2006 | Hsu | F21L 4/06<br>362/396 |
| 2009/0039230 | A1* | 2/2009 | Cheng | A47G 33/12<br>248/523 |
| 2010/0176267 | A1* | 7/2010 | Chen | A47G 33/12<br>248/523 |
| 2017/0231412 | A1* | 8/2017 | Cheng | E04H 12/2238<br>248/523 |

* cited by examiner

UNIVERSAL TREE STAND SYSTEMS AND METHODS

CROSS-REFERENCE TO PRIORITY CLAIM

This application claims the benefit, under 35 U.S.C. § 119(e), of U.S. Provisional Patent Application No. 62/295,726, filed 16 Feb. 2016, entitled "Universal Tree Stand Systems and Methods," the entire contents and substance of which is incorporated herein by reference in their entirety as if fully set forth below.

TECHNICAL FIELD

Aspects of the present disclosure generally relate to a tree stand for securing a tree in an upright position, and, more particularly, for interchangeably supporting multiple trees having different trunk diameters or multiple poles having different diameters (hereinafter referred to collectively as "trees").

BACKGROUND

Tree stands are commonly used to prop up and support trees. For example, tree stands are often used to support Christmas trees, including artificial Christmas trees. Some tree stands are designed to hold a tree truck of a particular size and shape. Other tree stands may be capable of supporting tree trunks of different sizes.

For example, one design of a tree stand capable of supporting tree trunks of different sizes may involve providing screws around the trunk that may be tightened such that they apply pressure to the circumference of the tree trunk. However, this method can be difficult to use as it may require a user to properly balance the forces provided by each screw so that the tree trunk does not tilt in one direction. Additionally, this method may damage the tree trunk as it requires the point of the screw to be driven into the trunk. Many other types of tree stands are only designed to accommodate and hold one size tree with a set tree diameter. This is problematic because trees, such as artificial Christmas trees, come in many different sizes with tree trunks of different sized diameters.

SUMMARY

Aspects of the present disclosure provide improved tree stands for supporting trees having different sized trunk diameters and that can tightly support a tree trunk in a manner that does not cause damage to the trunk.

According to an example implementation, a tree stand is provided. The tree stand may comprise a hollow base and a clamping element that may be attached proximate one end of the base. The tree stand may further comprise a fastening element configured to engage the clamping element and a limiting element that is positioned within the base.

According to another example implementation, a clamping mechanism is provided. The clamping mechanism may be configured to secure an elongate pole. The clamping mechanism may comprise a clamping element configured to attach to a base and a fastening element configured to engage the clamping element.

According to another example implementation, a system is provided. They system may comprise a tree and a base configured to receive at least a part of the trunk of the tree. The system may further comprise a clamping element attached a first end of the base, a fastening element configured to engage the clamping element, and a limiting element positioned within the base. The limiting element may be configured to prevent the trunk from extending through a second end of the base.

Other implementations, features, and aspects of the disclosed technology are described in detail herein and are considered a part of the claimed disclosed technology. Other implementations, features, and aspects can be understood with reference to the following detailed description, accompanying drawings, and claims.

BRIEF DESCRIPTION OF THE FIGURES

Reference will now be made to the accompanying figures, which are not necessarily drawn to scale, and wherein.

DETAILED DESCRIPTION

Figure 1:
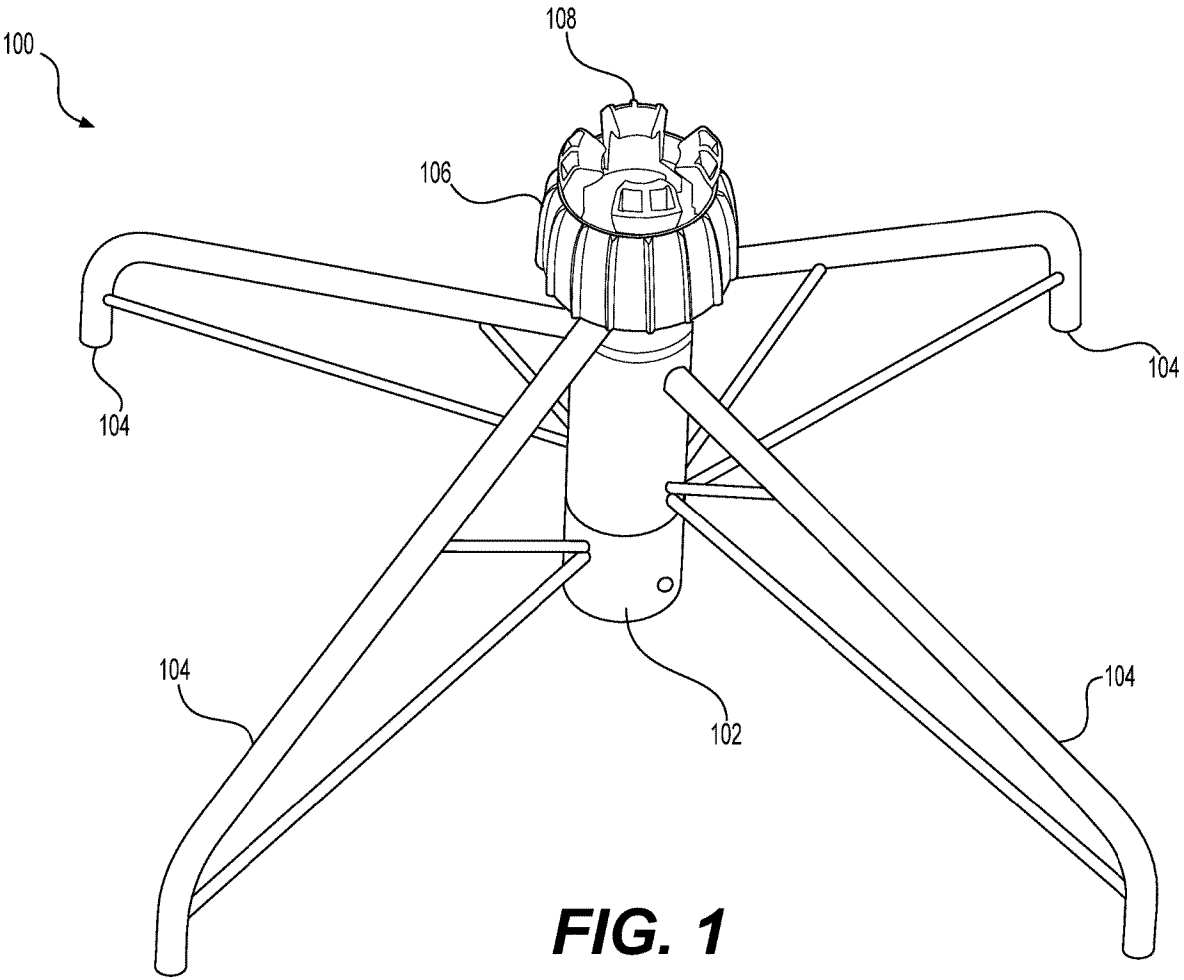
FIG. 1 is a perspective view of a universal tree stand, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Embodiments of the disclosed technology include a universal tree stand for supporting trees having tree trunks of various sizes. In various embodiments, a universal tree stand may receive a tree trunk through a clamping element that can flexibly receive trunks of different diameters. According to some embodiments, a user may further secure the tree trunk by adjusting a fastening element that may cause the clamping element to tighten its grip on the tree trunk.

Throughout this disclosure, certain embodiments are described in exemplary fashion in relation to a universal tree stand for supporting a tree. However, embodiments of the disclosed technology are not so limited. In some embodiments, the disclosed technique may be effective in supporting other structures having a truck-shaped portion, such as a pole or beam. For example, a universal tree stand can be used to support a flagpole or any other similar structure.

Figure 2A:
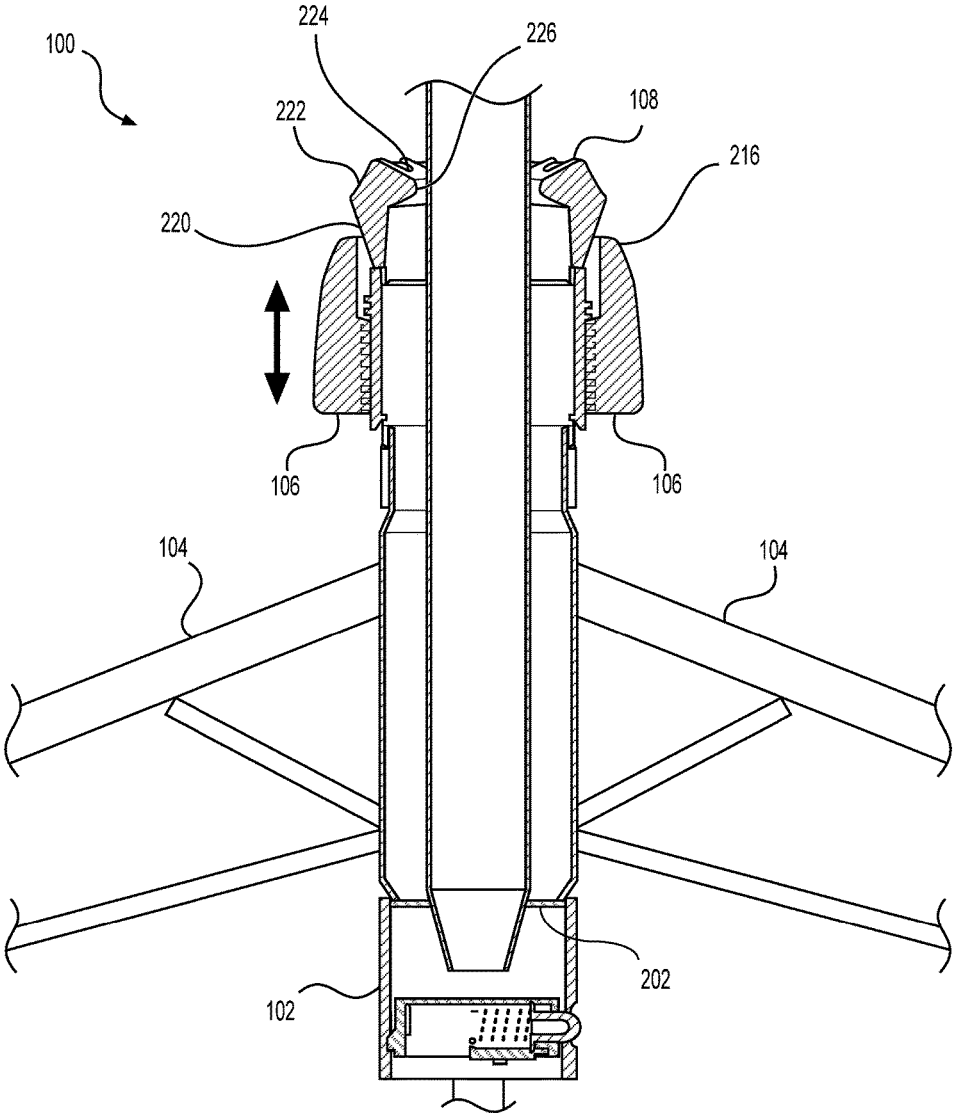
FIG. 2A is a cross-sectional view of a universal tree stand with the tree trunk installed, in accordance with an example embodiment of the presently disclosed subject matter.

Referring now to the drawings, FIGS. 1 and 2A illustrate an example embodiment of a universal tree stand 100. In some embodiments, a universal tree stand 100 may include a base 102 with a base support 104 configured to maintain the base 102 in a generally upright position. In some embodiments, the universal tree stand may include a plurality of base supports 104. In some embodiments, one, some, or all of the base supports 104 may be attached at or near the bottom end of the base 102. In some embodiments, one, some, or all of the base supports 104 may be attached at or near the top end of the base 102. In some embodiments, one, some, or all of the base supports 104 may be attached at or near the middle of the base 102. According to some embodiments, a clamping element 108 may surround or attach to the base 102. According to some embodiments, a fastening element 106 may surround or attach to the base 102 and/or the clamping element 108. According to some embodiments, the fastening element 106 can be used to adjust a clamping element 108. For example, in some embodiments, the fastening element 106 may be used to adjust how tightly the clamping element 108 grips a tree trunk.

As shown in FIG. 1, according to some embodiments, a base 102 of a universal tree stand 100 may be a generally cylindrical tube capable of receiving a tree trunk. The base 102 may be made out of a rigid material, such as metal, wood, plastic, or any other suitable material. In some embodiments, the base 102 may be hollow, and may receive a portion of a tree trunk. The base supports 104 can be legs or any other support structure suitable to enable the base 102 to securely stand in an upright position while supporting the weight of a tree. As shown in FIG. 1, the universal tree stand 100 can include four base supports 104, but other configurations, such as three base supports 104, are contemplated. In some embodiments, the base may be capable of standing upright without the use of base supports 104. For example, according to some embodiments, a base 102 may be supported by a base plate positioned at the bottom of the base 102 that extends outwards from the base 102 and lays flush against the floor. According to some embodiments, one or more base supports 104 may be folded to create a more compact object for storage. In some embodiments, one or more supports 104 may be rotated around the base 102 to allow a user to position the base supports appropriately to support the base 102 or store the stand 100. For example, in some embodiments, the base 102 may comprise multiple segments that are rotatably attached to one another. Each base support 104 may be attached to one or more of these segments, which may allow one or more of the base supports 104 to rotate with respect to the other base supports 104.

Figure 2B:
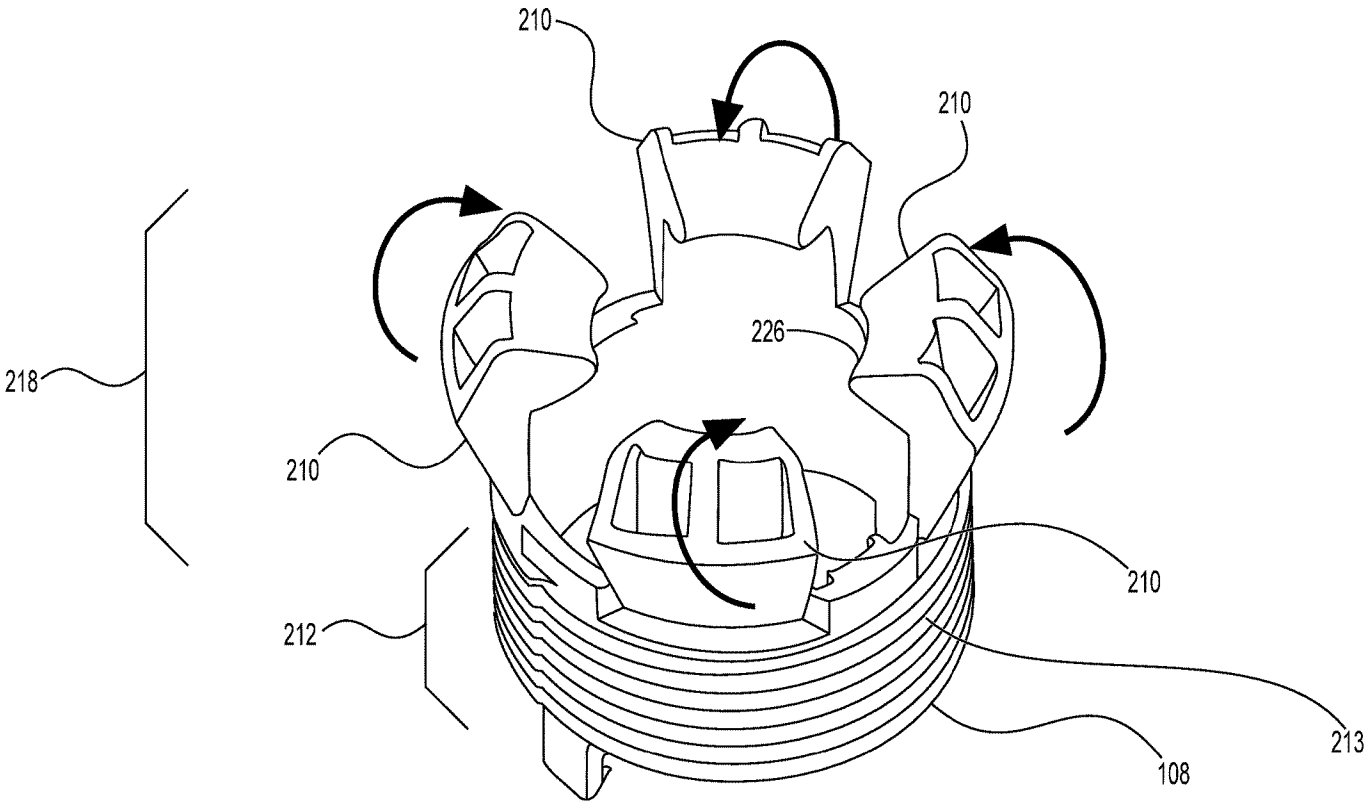
FIG. 2B is a perspective view of a clamping element of a universal tree stand, in accordance with an example embodiment of the presently disclosed subject matter.

As described above, a common problem with many tree stand designs is that they are designed only to receive a single size of tree trunk. To address this problem, according to some embodiments, the universal tree stand 100 may include a clamping element 108 that can secure tree trunks having different diameter sizes. As will be discussed, in some embodiments, the clamping element 108 can attach to or surround a top portion of the base 102. According to some embodiments, a clamping element 108 may be generally cylindrical with an aperture in the middle. As shown in FIG. 2B, a clamping element 108 may have a lower portion 212 and an upper portion 218. According to some embodiments, the lower portion 212 of the clamping element may be designed to attach to an upper portion of the base 102. For example, in some embodiments, the lower portion 212 may be hollow, having a generally cylindrical shape such that the lower portion 212 may fit around the outer circumference of a generally cylindrical base 102. The lower portion 212 may also have threading 213 on an external surface, as shown in FIG. 2B. According to some embodiments, the upper portion 218 of the clamping element 108 may include a plurality of clamping arms 210 that may extend upward, away from the base 102. Clamping arms 210 may serve to grip and secure a tree trunk or pole placed into the base 102. The clamping element 108, including the clamping arms 210, may be made from any resilient material that allows repetitive clamping and unclamping (i.e, recovery of the clamping arms 210 to an "open" position). For example, and not limitation, certain embodiments may include a clamping element 108 made from polypropylene (PP), polyethylene (PE), or an equivalent resin that may provide a flexible construction.

As stated above, the clamping arms 210 of the upper portion 218 of the clamping element 108 may serve to receive and tightly secure a tree trunk 200. As shown in FIG. 2B, the clamping arms 210 may generally extend upward away from the lower portion 212. According to some embodiments, a clamping arm 210 may have a lower portion with an outer surface 220 that extends at an angle outward and away from the aperture of the clamping element 108, as shown in FIG. 2A. In some embodiments, the clamping arm 210 may have an upper portion with an outer surface 222 that is angled inward toward the aperture of the clamping element 108. In some embodiments, the upper portion of the clamping arm 210 may have a top surface 224 that extends downward toward the aperture of the clamping element 108, as shown in FIGS. 2A and 2B.

In some embodiments, the clamping element 108 may include four clamping arms 210 spaced equidistantly around the edge of the upper portion of the clamping element 108. Multiple configurations of clamping arms 210 are contemplated, however. For example, some embodiments may include two clamping arms 210; other embodiments may include three, five, six, or more clamping arms 210. In some embodiments, the clamping arms 210 may be capable of flexibly rotating about the circumference of the clamping element 108, as shown in FIG. 2B. In some embodiments, each clamping arm 210 may have an inner edge 226 that has a rounded shape. In certain embodiments, one, some, or all of the clamping arms 210 may have an inner edge 226 that has a squared shape. The inner edge 226 of some embodiments may have a tapered shaped. As shown in FIG. 2B, the rounded inner edges 226 of the clamping arms 210 may form an inner circle. According to some embodiments, the downward slope of the top surfaces 224 of the clamping arms 210 and the rounded inner edges 226 of the clamping arms 210 may enable the clamping arms 210 to receive tree trunks of different sizes. Specifically, if a tree trunk 200 having a larger circumference than the inner circle formed by the inner edges 226 of clamping arms 210 is inserted through the clamping element 108, the tree trunk 200 may push against the downward sloped surfaces 224 of the clamping arms 210, and the downward force from the tree trunk 200 onto the downward sloped surfaces 224 of the clamping arms 210 can cause each of the clamping arms 210 to flex outward, away from the tree trunk 200, thereby allowing more space for the tree trunk 200 to pass through the clamping element 108.

As stated above, according to some embodiments, the clamping arms 210 may be flexibly attached to the lower portion 212 of the clamping element 108 such that, as shown in FIG. 2B, they may be capable of flexing away from the aperture of the clamping element 108 to accommodate the receipt of tree trunks having circumferences of varying size. In some embodiments, a spring force imparted by the resiliency of the clamping arms 210 may cause the clamping arms 210 to bend inward toward the aperture of the clamping element 108. Thus, when a tree trunk 200 is inserted through the aperture of clamping element 108, it may drive the clamping arms outward as described above, and the spring force of the clamping arms 210 may cause the clamping arms 210 to press against the outer surface of the tree trunk 200, as shown in FIG. 2A. Thus, according to some embodiments, when a user places a tree trunk through the clamping element 108, the clamping arms 210 may be pushed outward, flexing away from the aperture of the clamping element 108 to a position where the clamping arms 210 can press on the outer surface of the tree trunk, securing the tree trunk 200 in place.

Figure 2C:
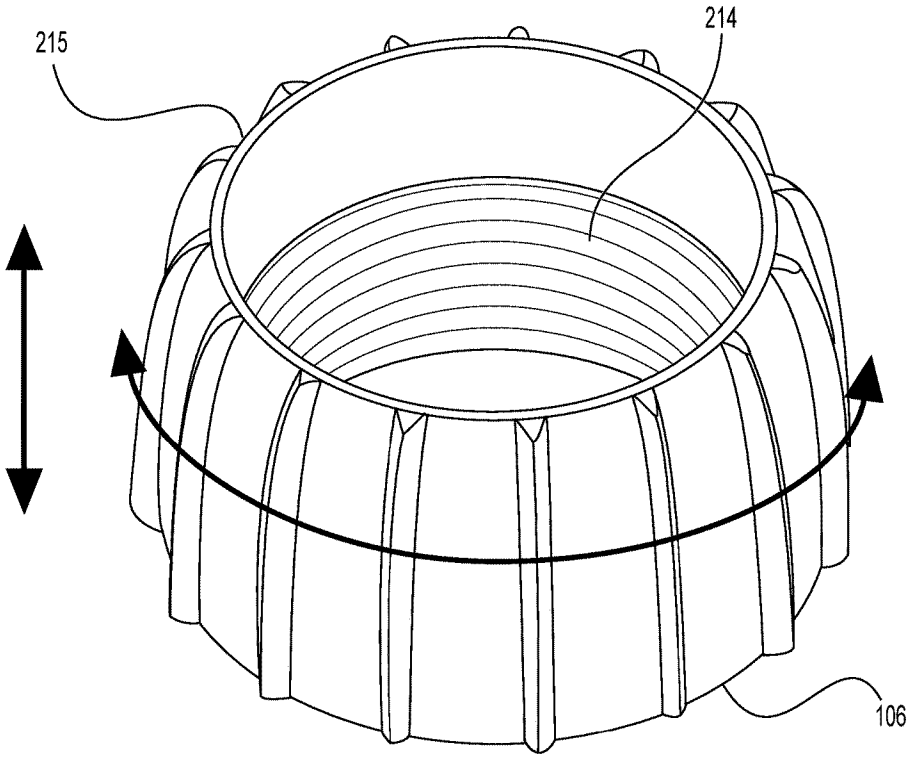
FIG. 2C is a perspective view of a fastening element, in accordance with an example embodiment of the presently disclosed subject matter.
Figure 2D:
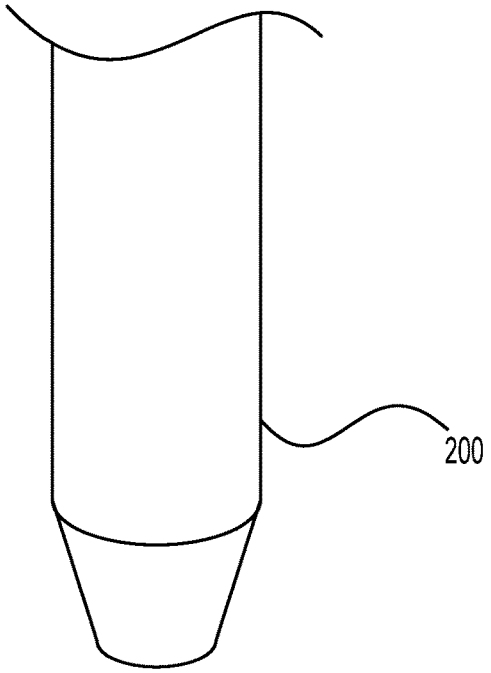
FIG. 2D is a side view of a portion of tree trunk secured by a universal tree stand, in accordance with an example embodiment of the presently disclosed subject matter.

According to some embodiments, a fastening element (or fastening nut) 106 may be used to tighten the grip of the clamping element 108 on the tree trunk 200. In some embodiments, the fastening element 106 may have an upper contact surface 215 that interacts with the clamping element 108. In some embodiments, the fastening element may be configured to engage with and disengage from the clamping element. According to some embodiments and as shown in FIGS. 2A and 2B, the lower portion 212 of the clamping element 108 may include external threading or external ridges 213. As shown in FIGS. 2A and 2C, in some embodiments the fastening element 106 may include internal threading or internal ridges 214 that are designed to interact with the external ridges 213 of the lower portion 212 of the clamping element 108. For example, the fastening element 106 may be placed around the clamping element 108 about the external ridges of the lower portion 212. The fastening element 106 may then be rotated in a manner similar to a nut being tightened on a bolt. According to some embodiments, rotating the fastening element 106 in a first direction (e.g., clockwise) may cause the fastening element 106 to move vertically up the clamping element 108. Rotating the fastening element 106 in a second direction (e.g., counterclockwise) may cause the fastening element 106 to move vertically down the clamping element 108.

In some embodiments, the fastening element 106 may be rotated as described above such that the fastening element 106 moves upward toward the clamping arms 210. When the fastening element 106 moves upward toward the clamping arms 210, in some embodiments, the upper contact surface 215 of the fastening element 106 may contact the outer surface 220 of the clamping arm 210 that extends at an angle outward away from the aperture of the clamping element 108. In some embodiments, the upper contact surface 215 may be an outer surface of an upward protrusion of the fastening element 106. In some embodiments, if the upper contact surface 215 is pushed upward and into the outer, outwardly-angled surface 220 of the clamping arm 210, the upper surface may cause an inward force to be applied to the clamping arm 210, causing the clamping arm 210 to exert force on the tree trunk 200, thereby tightening the grip on of the clamping element 108 on the tree trunk 200, as shown in FIG. 2A.

As also shown in FIG. 2A, in some embodiments, the upper contact surface 215 of the fastening element 106 may interact with the clamping element 108 at an engagement point 216. In some embodiments, the engagement point 216 may be the point where the upper contact surface 215 of the fastening element 106 touches the outer surface 220 of the clamping arm 210 that extends at an angle outward away from the aperture of the clamping element 108. According to some embodiments, the lower portion of each clamping arm 210 of the clamping element 108 may taper inward to cause a reduction of the circumference of the clamping element 108 from the clamping arms 108 to the base of the clamping element 108. In some embodiments, the engagement point 216 may refer to location of the interaction between the top portion of the fastening element 106 with a portion of the clamping element 108. Thus, as shown in FIG. 2A, the top portion of the fastening element 106 may contact an outer surface 220 of the clamping arms 210, both restricting the clamping arms' 210 ability to flex outward and tending to cause the clamping arms to press inward, thereby causing more force to be applied to a tree trunk 200 present within the clamping element 108. Thus, according to some embodiments, the fastening element 106 may be rotated in a manner that forces it upward toward the clamping arms 210, and the interaction between the fastening element 106 and the clamping arms 210 at the engagement points 216 may cause the clamping element 108 to tighten its grip on a tree trunk present within the clamping element 108. In some embodiments, the fastening element 106 may be rotated in the opposite direction to cause it move downward along the clamping element 108, lowering the upper contact surface 215 away from the clamping arms 210 and causing the inward force applied to the clamping arms 210 to be reduced. This reduction of inward force applied to the clamping arms 210 may allow the clamping arms 210 the freedom to flex further outward and may allow a user to more easily remove a tree trunk 200 from the tree stand 100 after use.

It will be understood by those of skill in the art that the fastening element 106 depicted in the figures is merely one embodiment of a device for fastening the clamping arms 210 of the clamping element 108 to the tree trunk 200 and that other embodiments may use other suitable devices to accomplish the same goal. For example, instead of being propelled upward or downward by twisting like a nut, in some embodiments, the fastening element 106 may be configured to slide up and down and be secured in place with a locking mechanism.

Figure 2E:
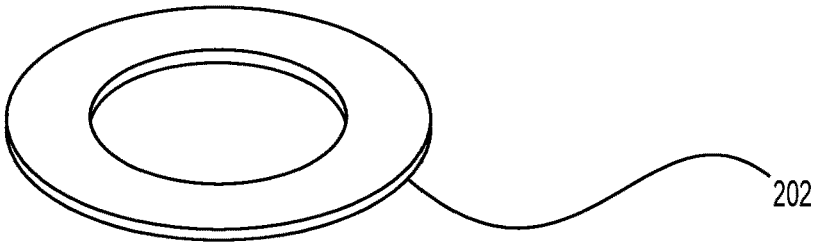
FIG. 2E is a perspective view of a limiting element of a universal tree stand, in accordance with an example embodiment of the presently disclosed subject matter.

As shown in FIGS. 2A and 2E, some embodiments of a universal tree stand 100 may include a limiting element 202 that can serve to limit how far down into the base 102 a tree trunk 200 is permitted to extend. In some embodiments, the limiting element 202 includes an aperture. In some embodiments, a limiting element 202 may be a ring. If the tree trunk 200 has a tapered end, the aperture of the limiting element 202 may receive the tapered end while preventing a portion of the tree trunk 200 having a diameter larger than the aperture of the limiting element 202 from passing through. Accordingly, the limiting element 202 may serve to position the bottom portion of the tree trunk 202 at a location within the base 102. The limiting element 202 may also serve to secure and provide support for the tree trunk 200. For example, the limiting element 202 may provide a vertical and lateral support for the tree trunk 200. In some embodiments, when a tree trunk is inserted into the tree stand 100, it may be secured laterally at both the limiting element 202 and the clamping element 106, thus preventing the tree trunk 200 from rotating, swaying, or leaning. In some embodiments, the limiting element 202 may be a flat surface that the tree trunk 200 may rest in or on top of. In some embodiments, the limiting element 202 may be of a hollow conical or frustoconical shape and positioned within the base 102 such that the longer-diameter end of the limiting element 202 is nearer the clamping element 108 than the smaller-diameter end of the limiting element 202. In some embodiments, the limiting element 202 may be plurality of arms originating from an internal circumference of the base 102 and extending downwards towards the bottom on the base 102 in a tapered fashion such that the circumference formed by the surfaces of the arms becomes smaller and smaller as they approach the bottom of the base 102. In some embodiments, the limiting element 202 may be positioned within the base 102 at or near the middle of the base 102. This may cause the base 102 to prevent the tree trunk 200 from extending past the bottom end of the base 102. In some embodiments, the limiting element 202 may be positioned within the base 102 proximate the bottom end of the base 102, which may allow a small portion of the tree trunk 200 to extend past the bottom end of the base 102. In some embodiments, the limiting element may be positioned at a location that is between the middle and the bottom end of the base 102.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tree stand comprising:

a hollow base having a first open end and a second open end;

a clamping element attached to the base proximate the first open end of the base, the clamping element including a plurality of clamping arms, each of the plurality of clamping arms configured to engage a tree trunk;

a fastening element configured to engage with and disengage from the clamping element and to transition the clamping element from a locked position to an unlocked position, the fastening element including an upper surface configured to engage an outer surface of each respective clamping arm of the plurality of clamping arms, such that when the upper surface of the fastening element is caused to apply force to the outer surface of each respective clamping arm, the respective clamping arm is moved toward a central axis of the clamping element, the central axis being substantially parallel to the axis of the tree trunk; and a limiting element positioned within the base, the limiting element configured to prevent the tree trunk from extending through the second open end of the base.

2. The tree stand of claim 1, wherein the tree stand further comprises a base support configured to maintain the base in an upright position, the base support attached to the base proximate the second open end of the base.

3. The tree stand of claim 1, wherein the clamping element further comprises threading on at least part of an exterior surface and the fastening element comprises threading on at least part of an interior surface, the threading of the fastening element configured to engage the threading of the clamping element.

4. The tree stand of claim 1, wherein each of the plurality of clamping arms has a rounded inner edge.

5. The tree stand of claim 1, wherein each of the plurality of clamping arms has a tapered inner edge.

6. The tree stand of claim 1, wherein each of the plurality of clamping arms has a squared inner edge.

7. A clamping mechanism for securing an elongate pole comprising:

a clamping element configured to attach to an end of a base, the clamping element (i) being separate and distinct from the base, (ii) including threading on at least part of an exterior surface, and (iii) comprising a plurality of clamping arms, each of the plurality of clamping arms having an inner edge and an outer surface; and a fastening element including threading on at least part of an interior surface, the threading of the fastening element configured to engage the threading of the clamping element, and the fastening element comprising an upper surface such that, when force is applied to the outer surface of a respective clamping arm via the upper surface of the fastening element, the inner edge of the respective clamping arm is caused to move toward a central axis of the clamping mechanism.

* * * * *